US012011802B2

(12) United States Patent
Blatz et al.

(10) Patent No.: US 12,011,802 B2
(45) Date of Patent: Jun. 18, 2024

(54) CLAMPING DEVICE AND HAND-HELD POWER TOOL

(71) Applicant: Hilti Aktiengesellschaft, Schaan (LI)

(72) Inventors: Thomas Blatz, Kaufering (DE); Karin Groth, Landsberg am Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 707 days.

(21) Appl. No.: 16/755,749

(22) PCT Filed: Oct. 16, 2018

(86) PCT No.: PCT/EP2018/078225

§ 371 (c)(1),
(2) Date: Apr. 13, 2020

(87) PCT Pub. No.: WO2019/081275

PCT Pub. Date: May 2, 2019

(65) Prior Publication Data

US 2020/0324385 A1 Oct. 15, 2020

(30) Foreign Application Priority Data

Oct. 27, 2017 (EP) ..... 17198870

(51) Int. Cl.
*B24B 45/00* (2006.01)
*B24B 23/02* (2006.01)

(52) U.S. Cl.
CPC ..... *B24B 45/006* (2013.01); *B24B 23/028* (2013.01)

(58) Field of Classification Search
CPC ..... B24B 23/028
USPC ..... 451/359
See application file for complete search history.

(56) References Cited

U.S. PATENT DOCUMENTS 3,266,535 A * 8/1966 Brodie ..... B27B 5/32 30/390
5,161,334 A * 11/1992 Schaal ..... B24B 45/006 411/432
5,494,368 A * 2/1996 Matthews ..... F16B 43/002 403/321

(Continued)

FOREIGN PATENT DOCUMENTS

CN 201284780 Y 5/2009
CN 205552271 U 7/2016

(Continued)

OTHER PUBLICATIONS

International Search Report of PCT/EP2018/078225, dated Nov. 26, 2018.

*Primary Examiner* — Robert F Long
*Assistant Examiner* — Xavier A Madison
(74) *Attorney, Agent, or Firm* — Davidson Kappel LLC

(57) ABSTRACT

A clamping device (10) for the axial (AR) clamping of a tool disk (300) on a flange (30) associated with a drive spindle (20) of a hand-held power tool (100), wherein the clamping device (100) has a screw (2), which is to be screwed into an internal thread (22) of the drive spindle (20) to securely clamp the tool disk (300), wherein the screw (2) is mounted in a coupling module (1) of the clamping device (10), wherein the coupling module (1) has an internal contour (16) which is paired or can be paired positively with the drive spindle (20) for conjoint rotation in the circumferential direction (U).

18 Claims, 6 Drawing Sheets

(56) References Cited

U.S. PATENT DOCUMENTS

| | | | | |
|---|---|---|---|---|
| 5,810,533 | A * | 9/1998 | Nakamura | B27B 5/32 411/408 |
| 6,273,659 | B1 * | 8/2001 | Goto | B24B 45/006 411/917 |
| 6,843,627 | B2 * | 1/2005 | Childs | B27B 5/32 411/408 |
| 8,366,366 | B2 * | 2/2013 | Hirabayashi | B27B 5/32 411/408 |
| 9,789,624 | B2 * | 10/2017 | Kimura | B23D 45/042 |
| 2010/0040474 | A1 * | 2/2010 | Takahashi | B27B 5/38 416/219 R |
| 2016/0288359 | A1 * | 10/2016 | Patrick | B27B 5/32 |
| 2017/0276166 | A1 * | 9/2017 | Gunnin | B24B 23/005 |
| 2019/0039205 | A1 | 2/2019 | Groth et al. | |

FOREIGN PATENT DOCUMENTS

| | | | |
|---|---|---|---|
| DE | 6909435 | U | 7/1969 |
| EP | 2123380 | A1 | 11/2009 |
| EP | 3202533 | A1 | 8/2017 |
| JP | S49146591 | U | 12/1974 |
| JP | S6124153 | U | 2/1986 |
| JP | H07229743 | A | 8/1995 |
| JP | H07299743 | A | 11/1995 |
| KR | 101578730 | B1 | 12/2015 |
| WO | WO 2008084636 | A1 | 7/2008 |

* cited by examiner

CLAMPING DEVICE AND HAND-HELD POWER TOOL

The present invention relates to a clamping device for the axial clamping of a tool disk on a flange associated with a drive spindle of a hand-held power tool. The clamping device has a screw, which is to be screwed into an internal thread of the drive spindle to securely clamp the tool disk.

BACKGROUND

Clamping devices of this kind are known in principle from the prior art. Clamping devices having a clamping nut, in particular designed as a two-hole nut, which can be secured on the drive spindle by means of a corresponding tool, are likewise known from the prior art. However, the present invention relates to a different class of clamping devices, namely those which have a screw that can be screwed into an internal thread at the end of the drive spindle.

SUMMARY OF THE INVENTION

It is an object of the present invention to provide a clamping device which counteracts spontaneous release of the clamping device—and thus loosening of the tool disk during the operation of the hand-held power tool.

The present invention provides that the screw is mounted in a coupling module of the clamping device, wherein the coupling module has an internal contour which is paired or can be paired positively with the drive spindle for conjoint rotation in the circumferential direction.

The clamping device has the advantage that it can neither tighten nor loosen during the operation of the hand-held power tool because the coupling module, as part of the clamping device, is paired positively with the drive spindle for conjoint rotation. This is as a counterpart to a flange which is preferably paired positively with the drive spindle for conjoint rotation.

It has proven advantageous if the internal contour of the coupling module is designed as a hexagonal profile. A corresponding external contour of the drive spindle is preferably designed as an external hexagon. Alternative pairings that interlock positively for conjoint rotation, e.g. in the form of a positive shaft-hub connections, can be employed.

The internal thread of the drive spindle is preferably an internal thread at the end. The internal thread can be set back in the axial direction relative to a head surface of the drive spindle. The screw preferably projects in the axial direction beyond the coupling module, in particular relative to the cylindrical subsection of the coupling module. The coupling module is preferably of cylindrical design. The coupling module preferably has a cylindrical subsection which can project through a central opening in the tool disk. The cylindrical subsection of the coupling module can project into a central opening in the flange.

In a preferred embodiment, the clamping device has a knob, which is designed to be positively locked to the screw for conjoint rotation in the circumferential direction. Particularly simple handling of the clamping device is thereby possible. It is possible to dispense with an additional assembly tool, e.g. an assembly wrench.

In a particularly preferred embodiment, the clamping device has a clamping member, which can be subjected to an axial clamping force by means of the coupling module in order in this way to clamp the tool disk against the flange.

As a particular preference, the clamping member is designed as a spring plate. The spring plate can be of disk-shaped design.

In a preferred embodiment, the screw is mounted in the coupling module by means of a rolling bearing. An increased clamping force of the clamping device is obtained by virtue of the fact that head friction of the clamping element can be reduced with the aid of the rolling bearing.

As a particular preference, the rolling bearing is designed as an angular contact ball bearing. The angular contact ball bearing preferably has a contact angle of between 35° and 45°. The contact angle can be 40°. By virtue of the diagonal pressure angle of the rolling elements, especially in an angular contact ball bearing, the clamping device wedges radially toward the end of the clamping process. This offers increased security against unintentional release.

If the clamping device has a clamping member in the form of a spring plate, which is preferred, the clamping device obtains increased insensitivity to settling since the spring plate is in nonpositive engagement with the tool disk, which compensates thermal expansion.

In another embodiment, the clamping device has an elastomer ring, which is preferably arranged between a head of the screw and a collar of the coupling module. As an alternative or in addition, the clamping device can have a holding ring, by means of which the coupling module is held on the screw.

According to an advantageous embodiment of the present invention, it is also possible for a diaphragm spring to be provided instead of an elastomer ring. In this case, the diaphragm spring can serve to seal off a grease chamber between the screw head and the collar of the coupling module. Moreover, the diaphragm spring can also axially preload the knob.

According to another advantageous embodiment, it is furthermore possible to use a combination of an elastomer element and a mechanical spring instead of the elastomer ring.

It has proven advantageous if the clamping member is held on the coupling module by a retaining ring.

In another preferred embodiment, the clamping device has a stop, by means of which a deflection of the clamping member is limited directly or indirectly. The stop is preferably designed as an annular collar and is arranged between the spring plate and the tool disk to be received. If the tool disk comes into contact with the stop in the course of the clamping process, a deflection of the spring element in the axial direction is limited.

The present invention also provides a hand-held power tool, preferably in the form of a grinder or cutoff grinder, having a drive spindle, which has an internal thread, preferably at the end, and having a clamping device of the type described above. The drive spindle has an external contour which is paired or can be paired positively with the internal contour of the coupling module for conjoint rotation in the circumferential direction.

It has proven advantageous if the hand-held power tool comprises a flange, which is connected or can be connected positively to the drive spindle for conjoint rotation in the circumferential direction by means of an anti-rotation safeguard.

The hand-held power tool according to the invention can be developed advantageously in a corresponding manner by the features which are explained with respect to the clamping device.

Further advantages will emerge from the following description of the figures. Various exemplary embodiments of the present invention are illustrated in the figures. The figures, the description and the claims contain numerous features in combination. A person skilled in the art will expediently also consider the features individually and combine them to produce expedient further combinations.

BRIEF DESCRIPTION OF THE DRAWINGS

In the figures, identical components and components of identical type are designated by identical reference signs. In the figures.

DETAILED DESCRIPTION

Figure 1:
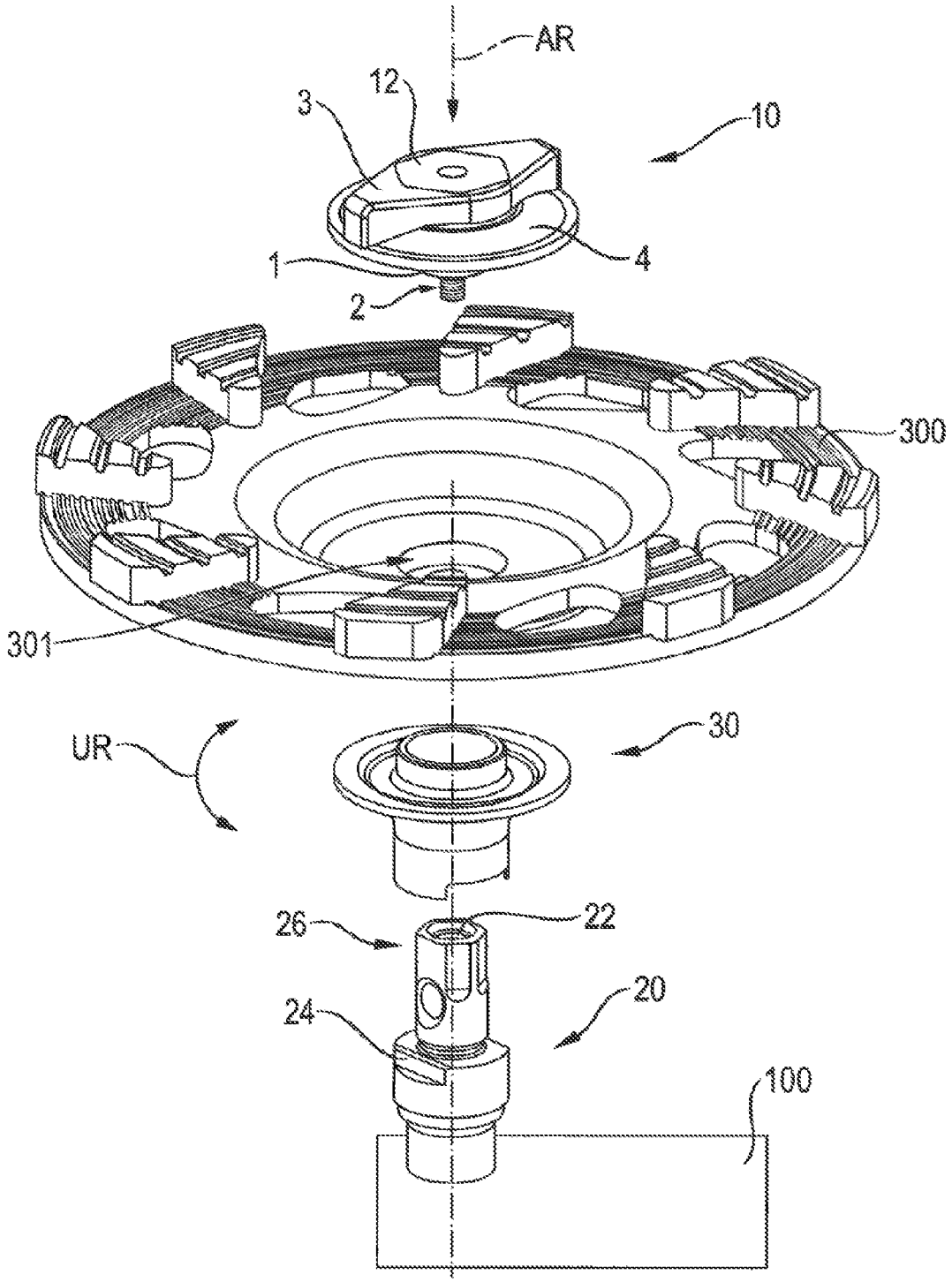
FIG. 1 shows a preferred exemplary embodiment of a clamping device according to the invention, together with a tool disk and a hand-held power tool.

A preferred exemplary embodiment of a clamping device 10 according to the invention is illustrated in FIG. 1. The clamping device 10 is used to clamp a tool disk 300 in the axial direction AR. The tool disk 300 can be clamped between the clamping device 10 and a flange 30, wherein the flange 30 is associated with a drive spindle 20 of a hand-held power tool 100.

The flange 30 has an anti-rotation safeguard 24 in the form of a lateral recess, ensuring that the flange placed on the drive spindle 20 is connected positively to the drive spindle 20 for conjoint rotation in the circumferential direction U.

As can be ascertained from FIG. 1, the clamping device 10 has a screw 2, which is to be screwed into an internal thread 22 on the end of the drive spindle 20 to securely clamp the tool disk 300. A coupling module 1 of the clamping device 10, which is provided according to the invention and in which the screw 2 is mounted centrally, can already be seen in initial form on the underside of the clamping device 10. The internal contour according to the invention is explained below in greater detail with reference to FIG. 2.

As can be seen from FIG. 1, the clamping device 10 has a knob 3. This is used to manually screw the screw 2 into the internal thread 22 and thus to axially clamp the tool disk 300 between the clamping device 10 and the flange 30. The knob 3 is designed to be positively locked to the screw 2 for conjoint rotation in the circumferential direction U. For this purpose, a head of the screw 12 has, by way of example, an external hexagonal contour which is embedded in a corresponding hexagonal internal contour of the knob 3. As an alternative to the hexagonal contour, however, it is also possible to use almost any other suitable contour.

As can be seen at the bottom in FIG. 1, the drive spindle 20 has an external contour which, in the present case, by way of example, is designed as a hexagonal profile. An internal contour of the coupling module 1 can be paired positively with this external contour 26. Positive pairing for conjoint rotation between the coupling module 1 and the external contour 26 is achieved when the clamping device 10 is clamped, wherein the coupling module 1 projects at least partially through a central opening 301 in the tool disk 300.

Figure 2:
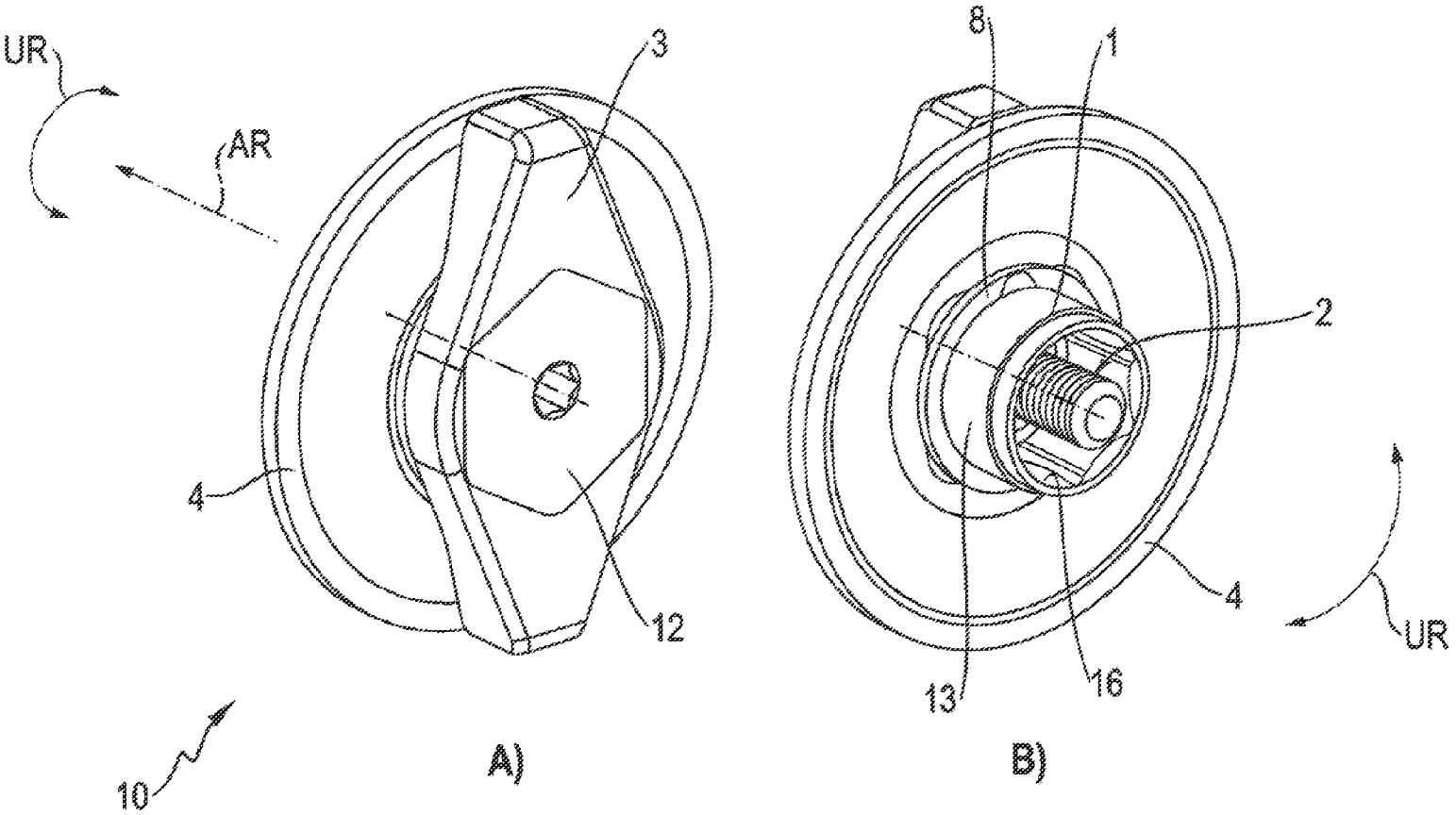
FIG. 2 shows the clamping device of FIG. 1 in a front and a rear view.

FIG. 2 then shows the clamping device 10 of FIG. 1 in plan view (FIG. 2A) and a bottom view (FIG. 2B).

Clearly apparent in FIG. 2A is the already described knob 3, in which the screw 2 is embedded positively for conjoint rotation in the circumferential direction by means of its head 12. The clamping device 10 likewise has a clamping member, which, by way of example, is here in the form of a dish-shaped spring plate 4. By means of the spring plate 4, the actual clamping force is applied to the tool disk 300.

The central screw 2 of the clamping device 10 is clearly discernible in FIG. 2B. The screw is mounted in the coupling module 1 of the clamping device 10, or, more precisely, the screw 2 is mounted coaxially in the coupling module 1. A cylindrical subsection 13 of the coupling module 1 is clearly discernible, wherein the cylindrical subsection 13 extends at least partially through the central opening 301 in the tool disk 300 when the tool disk 300 is clamped (cf. FIG. 1).

According to the invention, the coupling module 1 has an internal contour 16, which can be paired positively with the drive spindle 20 for conjoint rotation in the circumferential direction UR (cf. FIG. 1). According to the preferred embodiment illustrated, the internal contour 16 is designed as a hexagonal profile.

Figure 3:
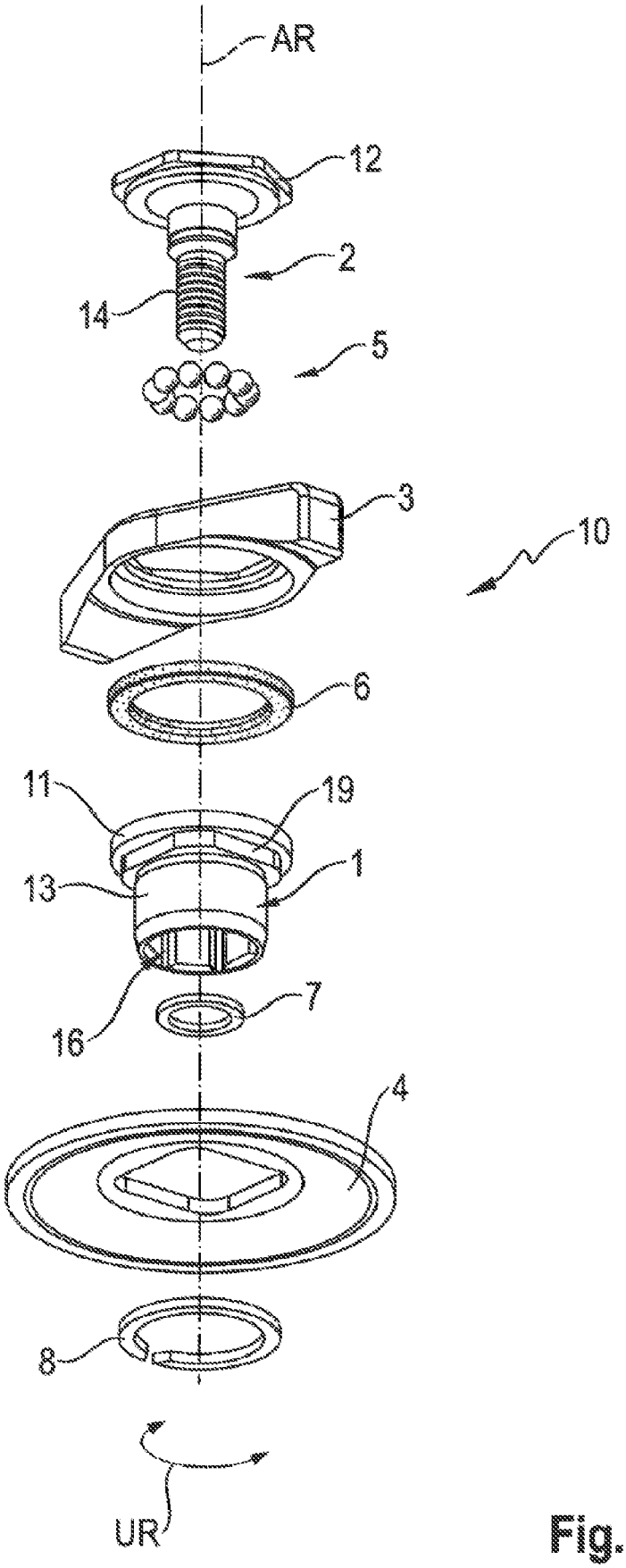
FIG. 3 shows the clamping device of FIGS. 1 and 2 in an exploded illustration.

FIG. 3 then shows the preferred exemplary embodiment of the clamping device 10 from the previous figures in an exploded illustration. Visible in the upper area of FIG. 3 is the screw 2 with the screw head 12 thereof, which has an external hexagonal contour by way of example. Visible in the lower area is a thread 14 of the screw 2, which is to be screwed into an internal thread (cf. FIG. 1: internal thread 22). The screw 2 is mounted in the coupling module 1 by means of a rolling bearing, preferably an angular contact ball bearing 5.

An elastomer ring 6, which is shown below the knob 3, is used inter alia to hold the external contour of the screw head 12 within a corresponding internal contour of the knob 3. This is evident especially from FIG. 4. Visible below the elastomer ring 6 is the coupling module 1, which, apart from the cylindrical subsection 13 already described and the internal contour 16 of hexagonal design, also has a collar 11. The collar 11 is designed and provided for the purpose of transmitting a clamping force applied via the knob 3 and the screw 2 to the spring plate 4.

The coupling module 1 can be paired positively with the spring plate 4 for conjoint rotation in the circumferential direction U, being paired in the assembled state. This preferably applies to all the exemplary embodiments. For this purpose, the coupling module 1 has a module contour 19 below the collar 11 of the coupling module 1 which corresponds to an internal contour of the spring plate 4. By way of example, the module contour 19 is designed as an external square. Visible below the coupling module 1 is a holding ring 7, by means of which the coupling module 1 is held on the screw 2.

The clamping member, here in the form of the spring plate 4, is held on the coupling module 1 by means of a retaining ring 8. The functioning of the clamping device 10 according to the invention will now be explained in greater detail with reference to FIG. 4.

First of all, the flange 30 (cf. FIG. 1) may be placed on the drive spindle 20 of the hand-held power tool 100. The flange 30 is connected positively to the drive spindle 20 for conjoint rotation in the circumferential direction U by the anti-rotation safeguard 24. The cutting disk 300 is then inserted. As the clamping element 10 is applied, the internal contour 16 (in the present case an internal hexagon) first of all comes into positive engagement for conjoint rotation with the external contour 26 of the drive spindle 20. This preferably takes place before the thread 14 of the screw 2 enters the internal thread 22 of the drive spindle 20.

As the clamping device 10 is screwed in, a manual force is transmitted to the screw 2 via an operating element, which is designed as a knob 3 by way of example. This is ensured by the fact that the head 12 of the screw 2 is embedded positively in the knob 3 for conjoint rotation in the circumferential direction. At the latest when the spring plate 4 is resting on the tool disk 300, the head 12 of the screw 2 slides relative to the coupling module 1 via the angular contact ball bearing 5 until there is radial clamping at the end of the spring travel of the spring plate 4. As a result, there is both axial and radial clamping between the head 12 of the screw 2 with respect to the coupling module 1, wherein, in particular, the radial clamping produces the greater holding effect. The radial clamping is achieved by virtue of the fact that the rolling bearing which is preferably provided is designed as an angular contact ball bearing 5, which has a contact angle BW of 40° (cf. also FIG. 5) by way of example. This increases head friction on the screw head 2, avoiding unintentional release of the clamping device 10.

The elastomer ring 6 situated between the coupling module 1 and the head 12 of the screw 2 on the one hand presses a section of the knob 3 against the screw head 12. It thereby serves to avoid any escape of lubricant from the rolling element space. On the other hand, the elastomer ring 6 in conjunction with the holding ring 7 holds the coupling module 1 on the screw 2. A retaining ring 8 illustrated below the spring plate 4 serves to hold the clamping plate 4 on the coupling module 1.

Figure 4:
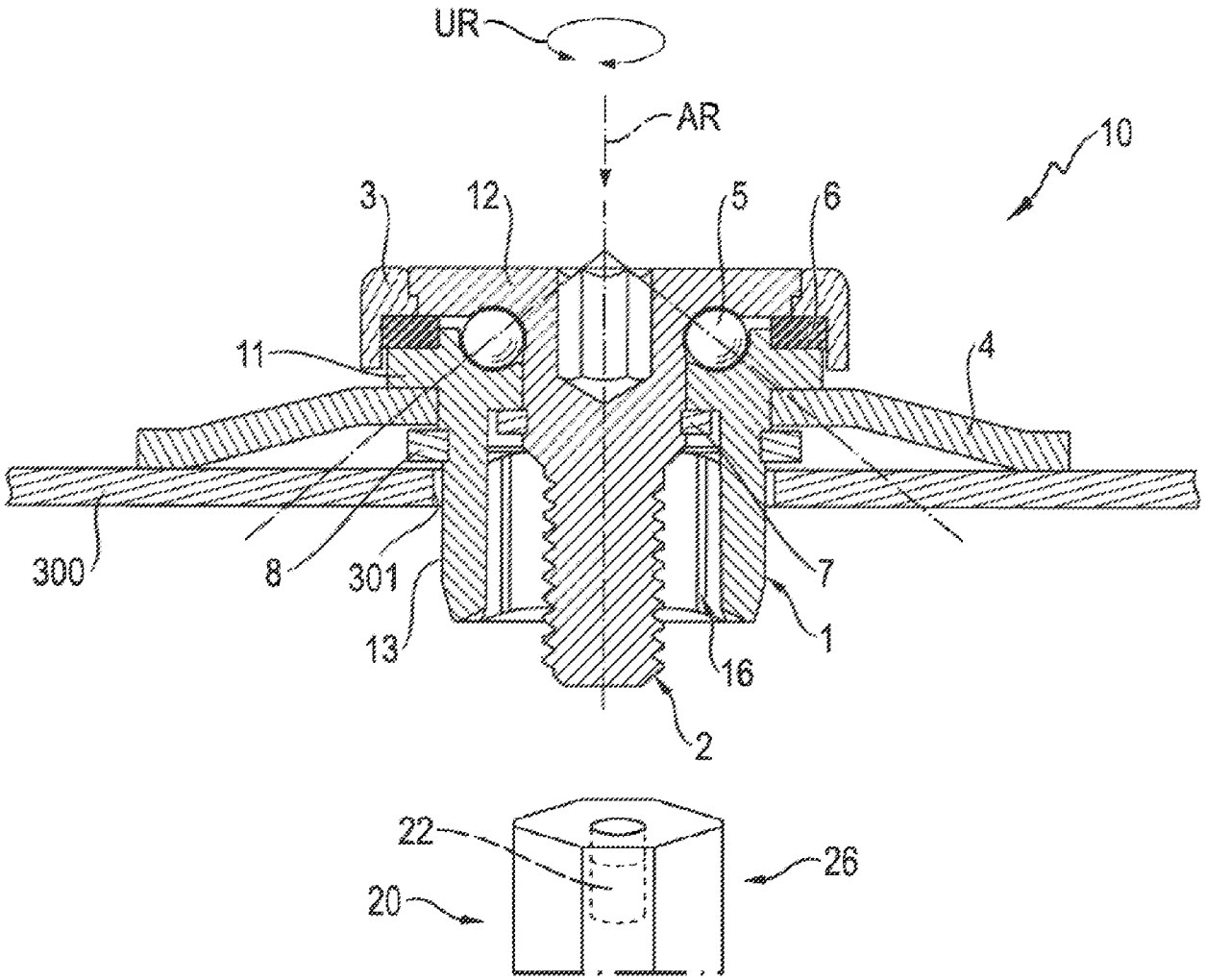
FIG. 4 shows the clamping device of the previous figures in a sectional illustration.

As can be seen from FIG. 4, the clamping force in the axial direction AR is transmitted via a collar 11 of the coupling module 1 to the spring plate 4 and, from there, to the tool disk 300. Relative to the circumferential direction UR, the spring plate 4 and the coupling module 1 are coupled to one another positively for conjoint rotation.

Figure 5:
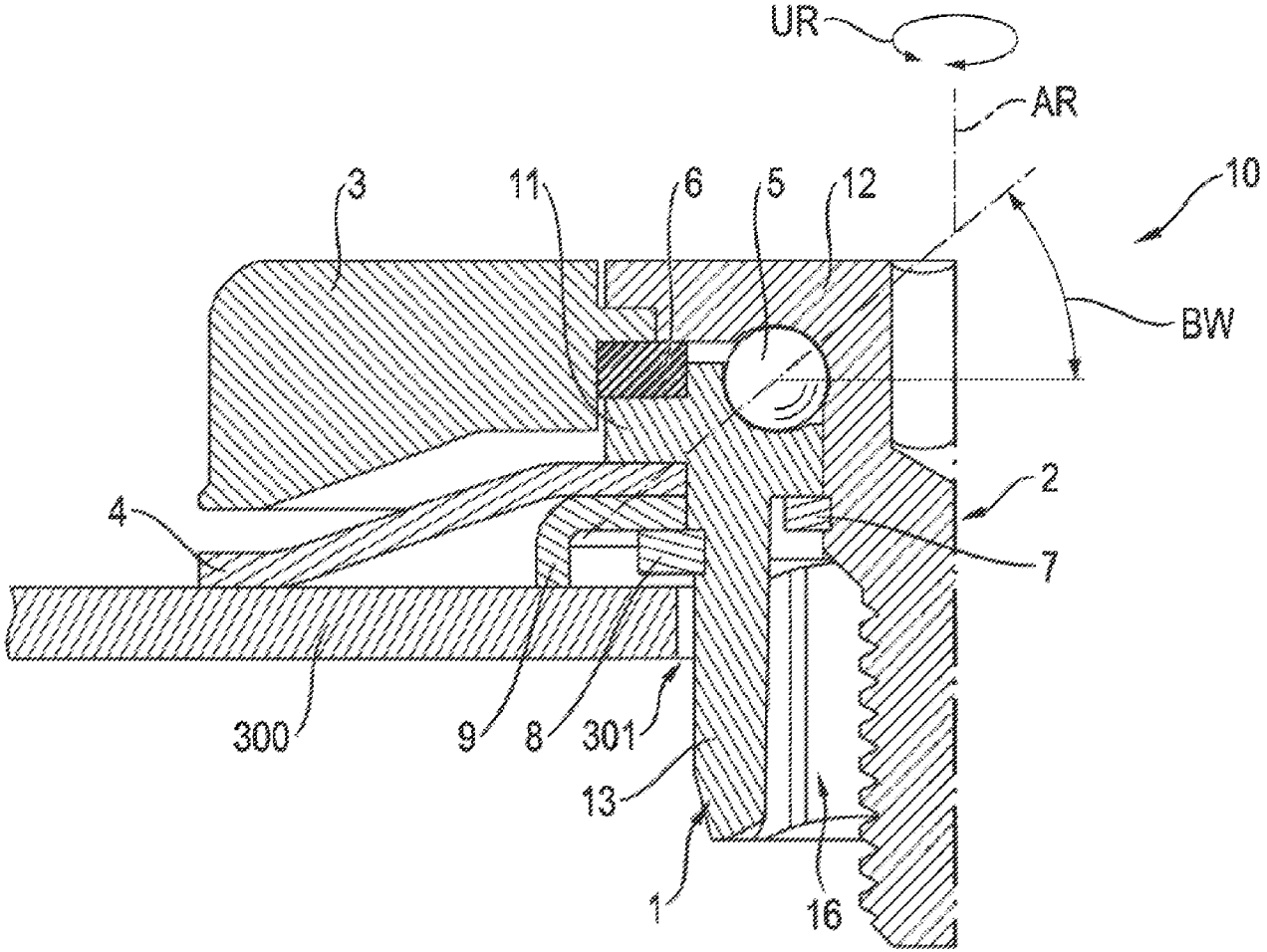
FIG. 5 shows a second exemplary embodiment of a clamping device according to the invention in partial section.

Finally, FIG. 5 shows another preferred exemplary embodiment of a clamping device 10 according to the invention. Here too, a rolling bearing in the form of an angular contact ball bearing 5, which has a contact angle BW of 40° (by way of example), is provided between the coupling module 1 and the screw 2. In contrast to the exemplary embodiment described with reference to FIG. 4, the exemplary embodiment of FIG. 5 has a stop 9, by means of which a deflection of the clamping member, which is here designed as a spring plate 4, can be limited.

Figure 5A:
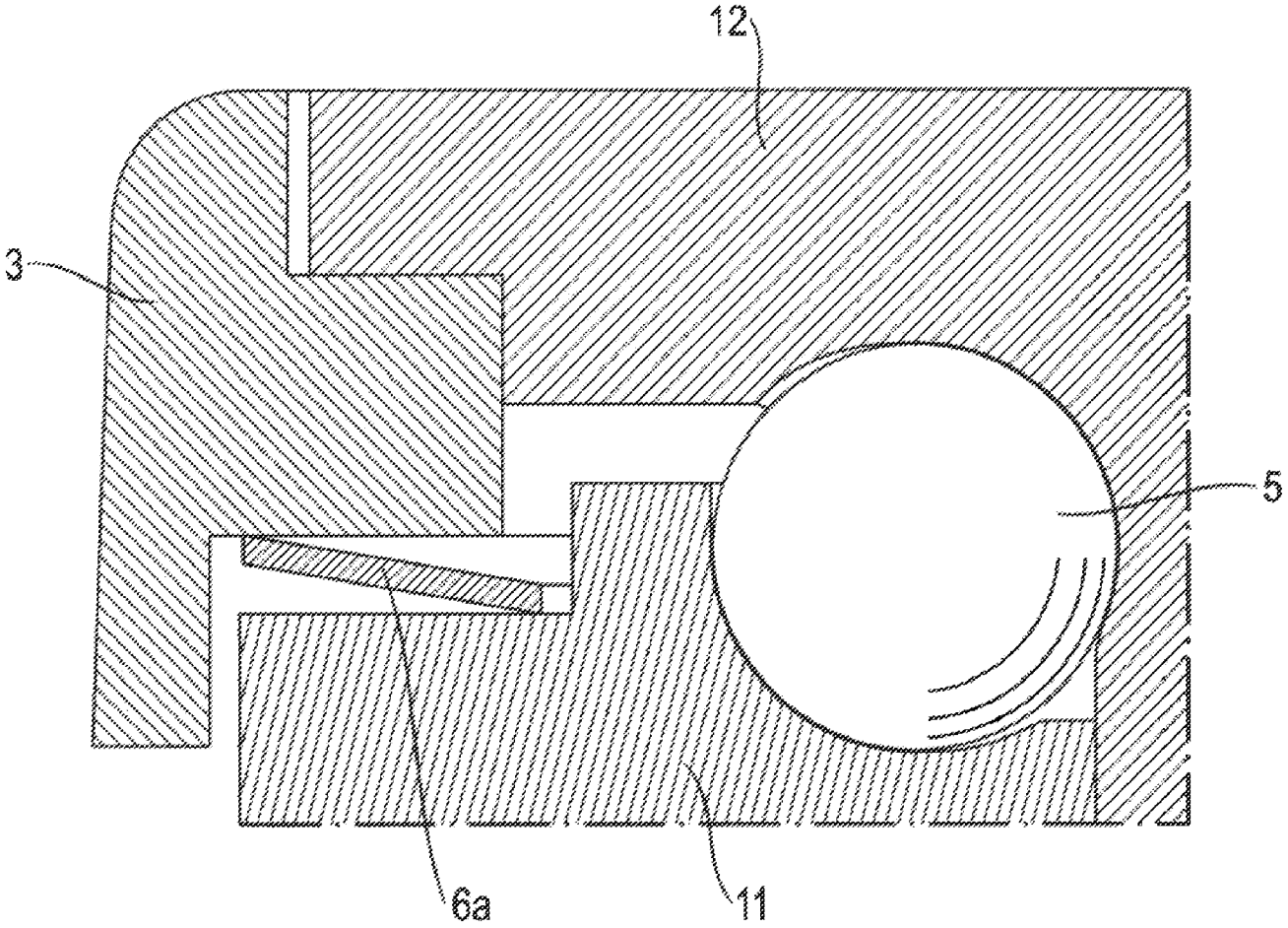
FIG. 5*a* shows a third exemplary embodiment of a clamping device according to the invention in partial section.

Another preferred exemplary embodiment of a clamping device 10 according to the invention is illustrated in FIG. 5*a*. Here too, a rolling bearing in the form of an angular contact ball bearing 5, which has a contact angle BW of 40° (by way of example), is provided between the coupling module 1 and the screw 2. In contrast to the exemplary embodiment described with reference to FIG. 4, a diaphragm spring 6*a* is provided instead of the elastomer ring 6 in order to seal off and preload the knob 3. As can be seen from FIG. 5*a*, the diaphragm spring 6*a* is here positioned between a lower side of the knob 3 and an upper side of the collar of the coupling module 11, with the result that the spring force of the diaphragm spring 6*a* acts on the lower side of the knob 3 and the upper side of the collar of the coupling module 11. The diaphragm spring 6*a* positioned in this way is used inter alia to hold the external contour of the screw head 12 within a corresponding internal contour of the knob 3.

LIST OF REFERENCE SIGNS

1 coupling module
2 screw
3 knob
4 spring plate
5 angular contact ball bearing
6 elastomer ring
6*a* diaphragm spring
7 holding ring
8 retaining ring
9 stop
10 clamping device
11 collar of the coupling module
12 head of the screw
13 cylindrical subsection
14 thread
16 internal contour
19 module contour
20 drive spindle
22 internal thread
24 anti-rotation safeguard
26 external contour
30 flange
100 hand-held power tool
300 tool disk
301 central through opening
AR axial direction
BW contact angle
U circumferential direction

What is claimed is:

1. A clamping device for axial clamping of a tool disk on a flange associated with a drive spindle of a hand-held power tool, the clamping device comprising:

a screw to be screwed into an internal thread of the drive spindle to securely clamp the tool disk, a coupling module, the screw being mounted in the coupling module, the coupling module having an internal contour pairable positively with the drive spindle for conjoint rotation in the circumferential direction;

the screw being mounted in the coupling module via a rolling bearing, the rolling bearing being an angular ball bearing;

a clamping member subjectable to an axial clamping force by the coupling module in order to clamp the tool disk against the flange; and a retaining ring, the clamping member being held on the coupling module by the retaining ring.

2. The clamping device as recited in claim 1 wherein the clamping device has a knob designed to be positively locked to the screw for conjoint rotation in the circumferential direction.

3. The clamping device as recited in claim 1 wherein the clamping member is a spring plate.

4. The clamping device as recited in claim 1 wherein the angular contact ball bearing has a contact angle of between 35 degrees and 45 degrees.

5. The clamping device as recited in claim 4 wherein the contact angle is 40 degrees.

6. The clamping device as recited in claim 1 further comprising an elastomer ring.

7. The clamping device as recited in claim 6 wherein the elastomer ring is arranged between a head of the screw and a collar of the coupling module.

8. The clamping device as recited in claim 1 further comprising a holding ring, coupling module being held on the screw via the holding ring.

9. The clamping device as recited in claim 1 further comprising a stop, a deflection of the clamping member being limited by the stop.

10. The clamping device as recited in claim 1 further comprising a diaphragm spring.

11. The clamping device as recited in claim 10 wherein the diaphragm spring is arranged between a head of the screw and a collar of the coupling module.

12. The clamping device as recited in claim 11 wherein the clamping device has a knob designed to be positively locked to the screw for conjoint rotation in the circumferential direction and wherein the diaphragm axially preloads the knob.

13. The clamping device as recited in claim 1 wherein the screw is slidable relative to the coupling module via the angular contact ball bearing to effect a radial and axial clamping.

14. A hand-held power tool comprising:

a drive spindle having an internal thread at an end;

a clamping device having a screw screwed into an internal thread of the drive spindle to securely clamp a tool disk, a coupling module, the screw being mounted in the coupling module, the coupling module having an internal contour, the screw being mounted in the coupling module via a rolling bearing, the rolling bearing being an angular ball bearing, a clamping member subjectable to an axial clamping force by the coupling module in order to clamp the tool disk against the flange, and a retaining ring, the clamping member being held on the coupling module by the retaining ring;

the drive spindle having an external contour paired positively with the internal contour for conjoint rotation in the circumferential direction.

15. The hand-held power tool as recited in claim 14 further comprising a flange connectable positively to the drive spindle for conjoint rotation in the circumferential direction an anti-rotation safeguard.

16. A cutoff grinder comprising the hand-held power tool as recited in claim 14.

17. A clamping device for axial clamping of a tool disk on a flange associated with a drive spindle of a hand-held power tool, the clamping device comprising:

a screw to be screwed into an internal thread of the drive spindle to securely clamp the tool disk, a coupling module, the screw being mounted in the coupling module, the coupling module having an internal contour pairable positively with the drive spindle for conjoint rotation in the circumferential direction;

the screw being mounted in the coupling module via a rolling bearing, the rolling bearing being an angular ball bearing;

a clamping member subjectable to an axial clamping force by the coupling module in order to clamp the tool disk against the flange; and a stop, a deflection of the clamping member being limited by the stop.

18. A clamping device for axial clamping of a tool disk on a flange associated with a drive spindle of a hand-held power tool, the clamping device comprising:

a screw to be screwed into an internal thread of the drive spindle to securely clamp the tool disk, a coupling module, the screw being mounted in the coupling module, the coupling module having an internal contour pairable positively with the drive spindle for conjoint rotation in the circumferential direction;

the screw being mounted in the coupling module via a rolling bearing, the rolling bearing being an angular ball bearing; and a diaphragm spring.

* * * * *